US006837012B2

(12) United States Patent
Scherrer et al.

(10) Patent No.: US 6,837,012 B2
(45) Date of Patent: Jan. 4, 2005

(54) STRUCTURAL PROFILED SECTION IN PARTICULAR FOR PARTITION

(76) Inventors: Jean-Marc Scherrer, 5A, Rue du College, Riedisheim (FR), F-68400; Jean-Paul Scherrer, 76A, Avenue de la Lere D.B., Mulhouse (FR), F-68100; Fernand Scherrer, 2, Rue Georges Bizet, Rixheim (FR), F-68170

( * ) Notice: Subject to any disclaimer, the term of this patent is extended or adjusted under 35 U.S.C. 154(b) by 28 days.

(21) Appl. No.: 10/204,001

(22) PCT Filed: Feb. 16, 2001

(86) PCT No.: PCT/FR01/00473

§ 371 (c)(1),
(2), (4) Date: Nov. 29, 2002

(87) PCT Pub. No.: WO01/61120

PCT Pub. Date: Aug. 23, 2001

(65) Prior Publication Data

US 2003/0140591 A1 Jul. 31, 2003

(30) Foreign Application Priority Data

Feb. 17, 2000 (FR) ..... 00 01959

(51) Int. Cl.[7] ..... E04F 19/04
(52) U.S. Cl. ..... 52/290; 52/238.1; 52/731.9

(58) Field of Search ..... 52/290, 238.1, 52/204.595, 731.9, 786.1, 786.11, 481.2, 220.7, 220.8, 241, 289, 702, 716.8, 716.1

(56) References Cited

U.S. PATENT DOCUMENTS

| | | | | |
|---|---|---|---|---|
| 3,293,813 A | * | 12/1966 | Emmons et al. | 52/238.1 |
| 3,460,302 A | | 8/1969 | Cooper | |
| 3,998,027 A | * | 12/1976 | Wendt et al. | 52/716.1 |

FOREIGN PATENT DOCUMENTS

| | | | | |
|---|---|---|---|---|
| EP | 0 738 804 | | 10/1996 | |
| FR | 2 153 198 | | 5/1973 | |
| FR | 2153198 | * | 5/1973 | 52/238.1 |
| GB | 685 617 | | 1/1953 | |
| GB | 685617 | * | 1/1958 | 52/238.1 |
| WO | 96 22430 | | 7/1996 | |

* cited by examiner

*Primary Examiner*—Naoko Slack
(74) *Attorney, Agent, or Firm*—Young & Thompson

(57) ABSTRACT

A structural profiled section, in particular for partitions, has cross-with two parallel U-shaped parts designed to receive the partition panels. The inner branches of the U-shaped parts are assembled by a transverse junction element arranged at a short distance from their respective bases.

13 Claims, 3 Drawing Sheets

STRUCTURAL PROFILED SECTION IN PARTICULAR FOR PARTITION

BACKGROUND OF THE INVENTION

The present invention relates to a metal profiled section intended in particular for making uprights supporting partitions.

Numerous types of metal profiled sections are known which, by various operations of metal fitting work and by an appropriate arrangement, make it possible to produce partitions adapted to constitute easily modulatable premises such as in particular offices.

A first drawback of the profiled sections of the prior state of the art is that, in order to make simple premises, one is obliged to resort to a large diversity of profiled sections of specific shapes, which obliges the user to have a large stock of all the necessary profiled sections, insofar as the lack of a model has the effect of stopping the whole of the production.

A second drawback is that the user, in order to ensure assembly of these profiled sections, is obliged to make veritable metal fitting operations such as milling work or bevel cutting. Under these conditions, it is understood that such operations of installation are long and complex and require the services of qualified staff. It is also understood that it is particularly difficult to ensure, in the factory, the prefabrication of the different elements.

U.S. Pat. No. 3,998,027 has proposed a profiled section of which the cross-section is formed by two parts in the form of a U, each intended to receive a partition element, of which the inner branches are joined in their upper part by a junction wall. Such a profiled section, apart from the fact that it does not allow an easy connection with other profiled sections from its junction element, due to the distance of these latter from the base of the profiled section, does not allow an easy association either, by reason of the positioning of this wall.

SUMMARY OF THE INVENTION

It is an object of the present invention to overcome these various drawbacks by proposing a novel type of metal profiled section which is able, particularly by combining it with one or more other identical profiled sections, to constitute virtually all the different essential sectioned elements which are necessary for constructing premises.

The present invention thus has for its object a structural profiled section, in particular for partitions, of which the cross-section comprises two parallel U-shaped parts, designed to receive partition panels, characterized in that the inner branches of the U-shaped parts are joined by a transverse junction element arranged at a short distance from their respective bases.

The height of the outer branches of the U-shaped parts will preferably be greater than that of the inner branches, the difference in height being substantially equal to the thickness of the profiled section, which will make it possible to arrange a planar cover closing the opening of the central branch of the profiled section and to have in the same plane the plane of the cover and the ends of the outer branches of the profiled sections with U-shaped cross-section.

In a form of embodiment of the invention, the total width of the profiled section will be equal to double the height of its outer branches.

Furthermore, in a particularly interesting form of embodiment of the invention, the distance between the two flanges of each of the two parts with U-shaped cross-section will be equal to the thickness of the partition panels and the length of the transverse junction element is equal to the space which it is desired to provide between the two partition panels.

This profiled section may be combined with itself to constitute in particular vertical uprights constituting junctions of a plurality of partitions, but it may also be used in combination with a complementary profiled section matching it, of which the cross-section comprises at least a U-shaped part, the width of its base being substantially equal to the space separating the two inner branches of the U-shaped parts of the basic profiled section. This complementary profiled section comprises on each of the sides forming the branches of the U, two parallel and longitudinal flanges of which the height is equal to the distance of the two U-shaped parts of the basic profiled section. In a variant, the upper parts of the two U-shaped branches of the complementary profiled section are joined by an element parallel to the base of this profiled section.

Connection of the first and second profiled sections is ensured in simple manner by means of U or square bracket fixation elements which are screwed therein. As a result, in order to effect a complete implementation of a partition supporting structure, the user will only need sawing, boring and self-tapping screwing means. In order to facilitate the positioning of the structure as best possible for the user, each of the profiled section elements, whether it be question of a principal profiled section or a complementary profiled section, may be cut out to measure in the factory.

Angular elements prefabricated in the factory, composed of an association of two profiled sections, might even be made.

The present invention thus also has for an object an angular element characterized in that it is constituted by the association of two profiled section elements of which at least one is a profiled section element according to the invention with an identical profiled section or a complementary profiled section.

The profiled sections according to the invention may be associated to form vertical uprights and in particular multidirection vertical uprights.

The present invention thus also has for an object a partition structure upright of the type comprising the association of at least two profiled sections of which the cross-section comprises two U-shaped parts intended to receive partition panels, which are joined in a zone slightly distant from their bases by a planar part. The upright will preferably comprise two profiled sections which will be joined by the base of the elements of which the cross-section is U-shaped and which constitutes a composite profiled section. In a form of embodiment of the invention, the upright will comprise two additional profiled sections of which the bases of the elements of U-shaped cross-section will be fixed on the outer sides of the U-shaped elements of the composite profiled section.

BRIEF DESCRIPTION OF THE DRAWINGS

Forms of embodiment of the invention will be described hereinbelow with reference to the drawing hereafter in which.

DESCRIPTION OF THE PREFERRED EMBODIMENTS

Figure 1:
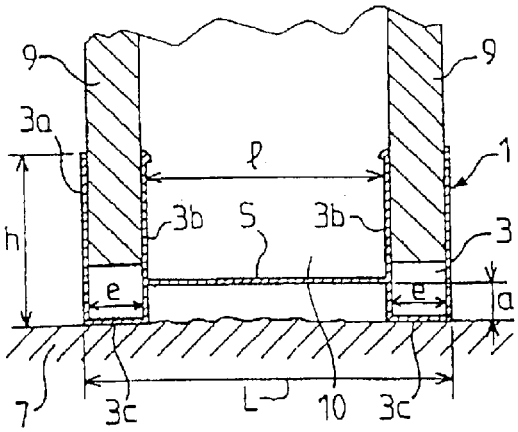
FIG. 1 is a horizontal cross-sectional view of a profiled section according to the invention which forms a vertical partition upright in abutment against a wall.

FIG. 1 shows a cross-section of a profiled section 1 according to the invention obtained in particular by extrusion. Such a profiled section comprises two U-shaped parts 3 which are parallel and which are joined at a distance a from their respective bases 3*c* by a planar part 5. In FIG. 1, the profiled section 1 is shown in horizontal section, so that it constitutes a vertical upright which is in abutment by its two bases 3*c* against a vertical wall 7. The interior of the two U-shaped parts 3 presents a width e equal to that of the wall panels 9 that they are intended to receive. Furthermore, the distance l separating the two inner branches 3*b* of the parts 3 with U-shaped cross-section is equal to the distance between panels desired for the wall thus produced. This width 1 corresponds for example to the thickness of the heat- and/or sound-insulation means which it is desired to arrange between these panels 9.

As will be set forth hereinbelow, the height h of the outer (3*a*) and inner (3*b*) branches of the U-shaped parts 3 will preferably be equal to half the width L of the profiled section 1.

Such a profiled section is particularly interesting in that, by reason of the considerable height of the branches 3*a* and 3*b*, it makes it possible to compensate for the non-perpendicularity of a floor and of a wall on which such profiled sections are applied. Furthermore, the profiled section coming into abutment on the wall 7, solely on two vertical zones corresponding to its base 3*c*, it will be understood that this profiled section occupies a stable position on the wall even if, as shown in FIG. 1, the latter presents irregularities between the two bases 3*c*.

Figure 3:
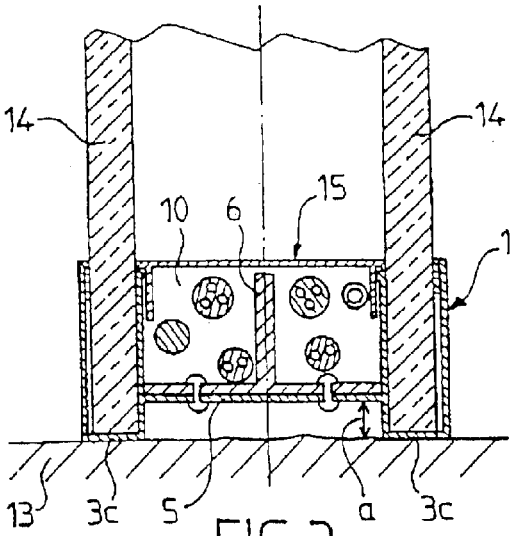
FIG. 3 is a vertical cross-sectional view showing an application of the profiled section of FIG. 2 to the making of a plinth in abutment on the floor.

Such a profiled section is also interesting insofar as it may be used both, as shown in FIG. 1, for constituting the vertical uprights of a frame for holding partition panels 9, and, as shown in FIG. 3, for making a plinth, i.e. a lower part of such a frame, or the upper part thereof. Such a profiled section has thus been used in FIG. 3 for making a plinth, i.e., in this Figure, the two bases 3*c* of the profiled section 1 are in abutment on a floor 13. The profiled section 1 ensures hold of two glass walls 14 which are positioned in the recess of U-shaped cross-section.

The profiled section 1 is also interesting in that it makes it possible to fix, in the volume 10 included between the two U-shaped parts 3, any hooking or separation device coming to be fixed on the planar element 5. The offset (of height a) of this planar element with respect to the bases 3*c* makes it possible, in effect, to employ systems of fixation, constituted for example by "pop" rivets or by screws, which can traverse the wall 5 without abutting against the plan (floor or wall) on which the profiled section is disposed, which would have the effect of disturbing correct abutment thereof.

Figure 2:
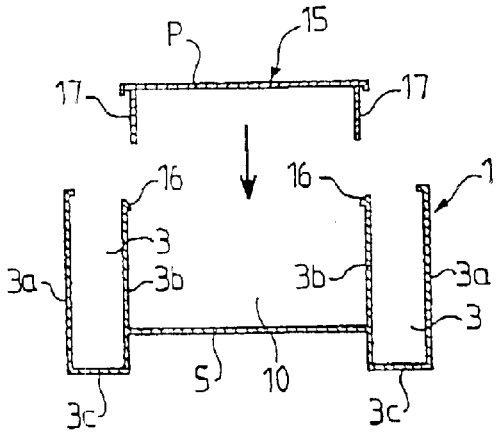
FIG. 2 is a horizontal cross-sectional view of a variant embodiment of the profiled section according to the invention shown in FIG. 1.

As shown in FIG. 2, the profiled section 1 or, more precisely the volume 10, may be closed by an obturator 15 whose cross-section is U-shaped and whose branches abut against the inner branches 3*b* of the parts 3. To that end, the inner branches 3*b* will be shorter than the outer branches 3*a* so that, once the obturator 15 is in position, the upper plan P thereof is in line with the upper part of the outer branches 3*a*, as shown in FIG. 3. The fixation of the obturator 15 may be ensured by the cooperation of ribs 16 provided on the profiled section 1 and of ribs 17 provided on the obturator 15. The closure of the inner volume 10 of the profiled section 1 gives the latter, on the other hand, advantages from the aesthetic standpoint when the partitions 14 are constituted by a transparent material, and also gives functional advantages of safety insofar as this closure makes it possible to reserve a volume for the passage of fixation elements and/or electrical cables or various conduits.

Figure 6:
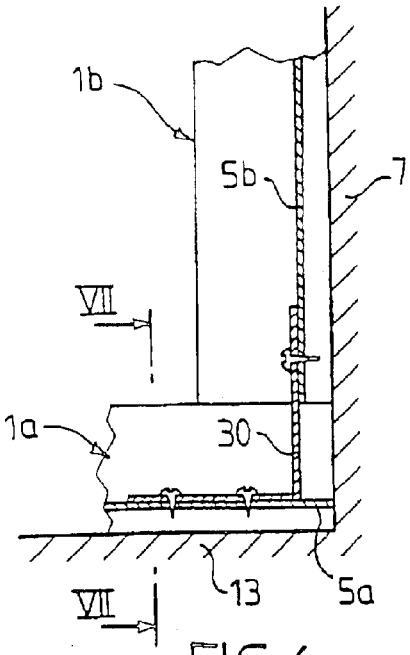
FIG. 6 is a view in vertical section of an angular association of two profiled sections according to the invention, along line VI—VI of FIG. 7.
Figure 7:
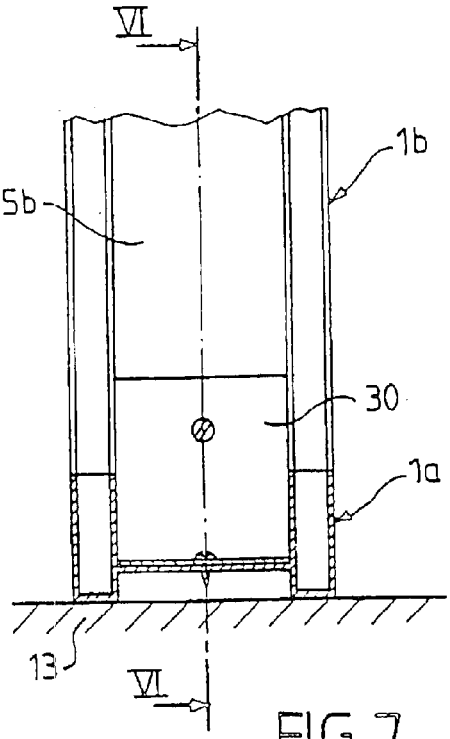
FIG. 7 is a view in vertical section of the angular association of two profiled sections according to the invention shown in FIG. 6, along line VII—VII thereof.

As shown in FIGS. 6 and 7, the profiled section according to the invention may be easily assembled in an angle with the aid of simple fixation means requiring only operations of sawing and of boring/screwing. In these Figures, a first profiled section 1*a* is in abutment on the floor 13 and thus constitutes a plinth and the second profiled section 1*b* is in abutment against a wall 7. The profiled section 1*b* is cut along its cross-section and is fixed on the profiled section 1*a* by means of a square bracket 30 of which the horizontal branch is screwed on the planar part 5*a* of the profiled section 1*a* and the vertical branch is fixed on the planar part 5*b* of the second profiled section 1*b*. Such a mode of fixation may be effected either by POP rivets or, as shown in FIGS. 6 and 7, by screws of which the ends will have the possibility of projecting in the space provided between the respective bases 3*c* of the profiled sections and the respective planar parts thereof. Such a mode of fixation in order to be simple is nonetheless aesthetic insofar as, once the obturator element 15 is placed in position, the fixation means are totally masked. The possibility of a fixation which is both simple and aesthetic results, as mentioned hereinabove, from the offset existing between the planar part 5 and the bases 3*b* of the profiled section.

Figure 4:
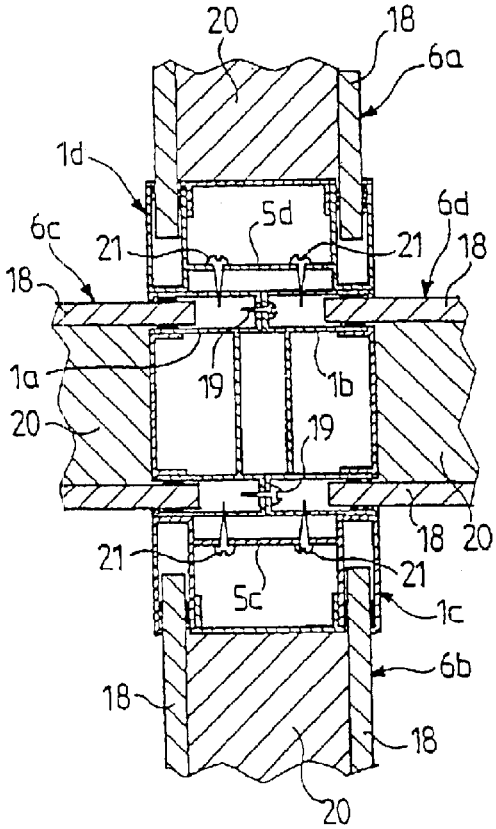
FIG. 4 is a horizontal cross-sectional view of an assembling of a plurality of profiled sections according to the invention which are associated to form an upright ensuring a vertical junction of four partitions.

The profiled section according to the invention may be used not only for constituting the vertical and horizontal uprights of a frame intended to hold partition panels, but also to make junctions, or crossings of various partitions, as shown in FIG. 4.

The latter shows an arrangement of a plurality of identical profiled sections 1 according to the invention making it possible to create a meeting point of four partitions 6*a*, 6*b*, 6*c*, 6*d* each constituted by two outer panels 18 and an insulating inner wall 20.

To make such a junction of walls, two profiled sections 1*a* and 1*b* according to the invention were, in a first step, associated in specific manner. Two of these profiled sections were thus disposed transversely so that their bases 3*c* are applied against each other by fixation means such as in particular by screws or "pop" rivets 19. A new composite profiled section is thus obtained, whose cross-section is inscribed in a square whose side is equal to 2h. On this composite profiled section thus obtained, two other profiled sections according to the invention 1*c* and 1*d* were, in a second step, fixed so that, as shown in FIG. 4, the bases 3*c* of these two other profiled sections 1*c* and 1*d* are applied against the outer branches 3*a* of the composite profiled section. Fixation is ensured by screws 21 which are introduced from the inner volume 10 of the profiled sections 1*c* and 1*d* in the planar parts 5*c* and 5*d* of these profiled sections and in the outer walls 3*a* of U-shaped cross-section of the composite profiled section and which are screwed in the outer branches of the U-shaped parts.

It is ascertained that the association of four profiled sections 1*a*, 1*b*, 1*c* and 1*d* enables a central and vertical assembly to be constituted, making it possible to effect the junction of four partitions.

Figure 5:
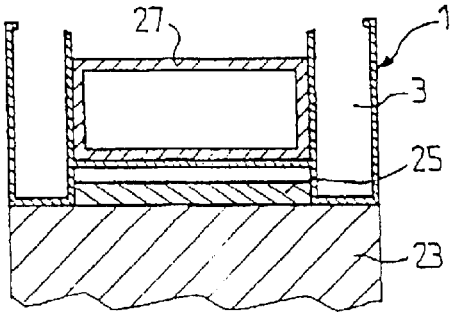
FIG. 5 is a horizontal cross-sectional view of a variant embodiment of the profiled section according to the invention shown in FIGS. 1 to 4.

As shown in FIG. 5, the profiled section 1 according to the invention is also interesting in that it may be centered rapidly with respect to an upright, particularly a vertical upright 23 by means of a shim 25 which is fixed on the upright 23 or which may be a boss thereof.

The profiled section 1 according to the present invention is also interesting in that it makes it possible to receive, once the structure is positioned, a stiffening element 27, constituted by a steel tube of rectangular cross-section of which the width corresponding to that existing between the inner walls of the profiled sections of U-shaped cross-section.

This stiffening element 27 has the effect, on the one hand, of improving all the mechanical characteristics of the profiled section, such as in particular its resistance to compression and to bending and, on the other hand, the fire-resistance of the structure. It may thus be used for easily and rapidly transforming normal partitions into fire-resistant partitions. It is thus particularly interesting when it is adapted to arrangements of partitions as well as those shown in FIG. 4.

In the prior state of the art, stiffening elements of this type have, of course, been used, but such elements were introduced by sliding in the tubes to be reinforced from one end thereof, which involved positioning them before the installation of the structure, so that it was in that case not possible to arrange them on a structure already in place which, upon use, proved to present too low a resistance.

The profiled section 1 according to the invention may be used in particular with a profiled section of complementary shape allowing other combinations. This complementary profiled section 40 is shown in FIGS. 12 and 8 to 10. This profiled section 40 has a cross-section in the form of a U whose lateral branches 40*a* are each provided with two small perpendicular flanges 40*b*. The distance of the inner faces of the branches 40*a* is equal to the distance l of the inner faces of the branches 3*b* of the principal profiled section 1 and the height of the flanges 40*b* is equal to the distance e of the branches 3*b* of this principal profiled section. It will thus be understood that the opening of the complementary profiled section 40 may be closed by the same obturator 15 as that used for the principal profiled section 1.

Figure 8:
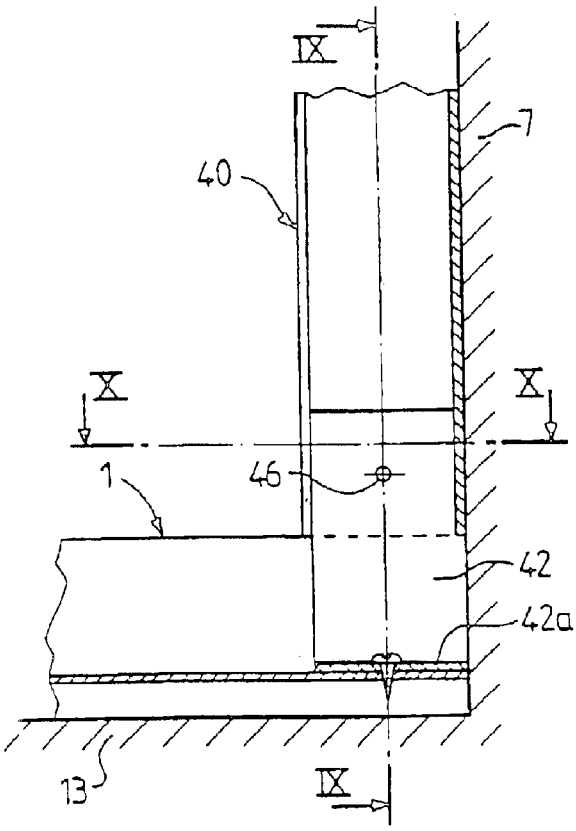
FIG. 8 is a view in vertical section of an angular association of a profiled section according to the invention and of a complementary profiled section, along line VIII—VIII of FIG. 9.
Figure 9:
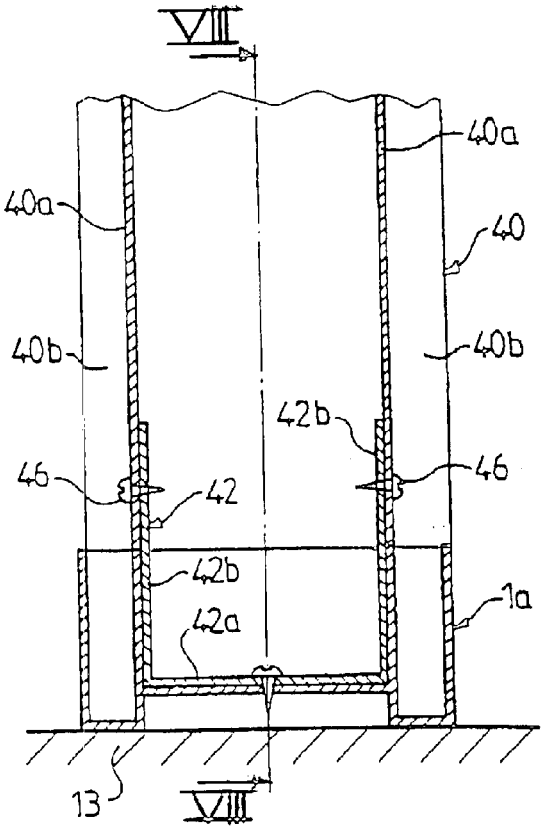
FIG. 9 is a view in vertical section of the angular association of the two profiled sections shown in FIG. 8, along line IX—IX thereof.
Figure 10:
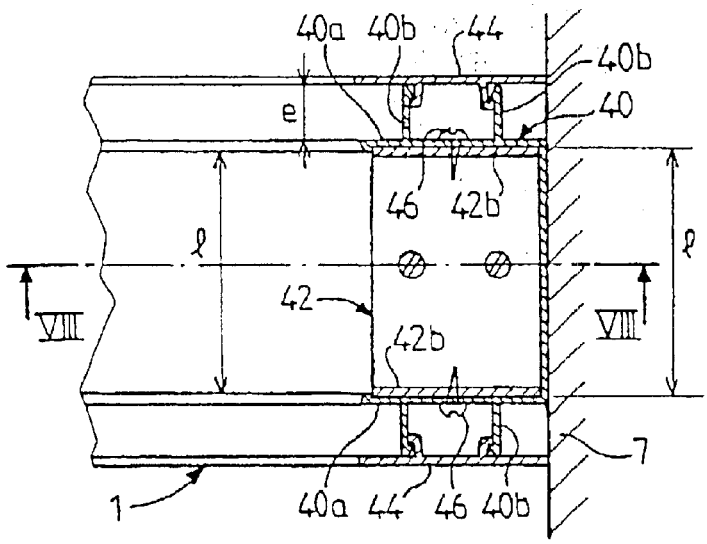
FIG. 10 is a view in horizontal section of the two profiled sections shown in FIGS. 8 and 9 along line X—X of FIG. 8.

FIGS. 8 to 10 show an arrangement of this complementary profiled section 40 with a principal profiled section 1 in which the latter forms a plinth in abutment on the floor 13 and the complementary profiled section 40 forms a vertical upright in abutment against a wall 7.

The combination of these two profiled sections is interesting insofar as, as previously, their assembly is effected from cut-outs at right angles and they are held by a simple U, particularly of bent sheet metal 42. As shown in the Figures, the base 42*a* of the U is fixed on the planar part 5 of the principal profiled section 1 and the complementary profiled section 40 is fixed on the branches 42*b* of the U from its walls included between the two flanges 40*b*. In this way, when an obturator 44 closes the space included between its two flanges 40*b*, the fixation means, particularly screws 46, will be masked.

Figure 11:
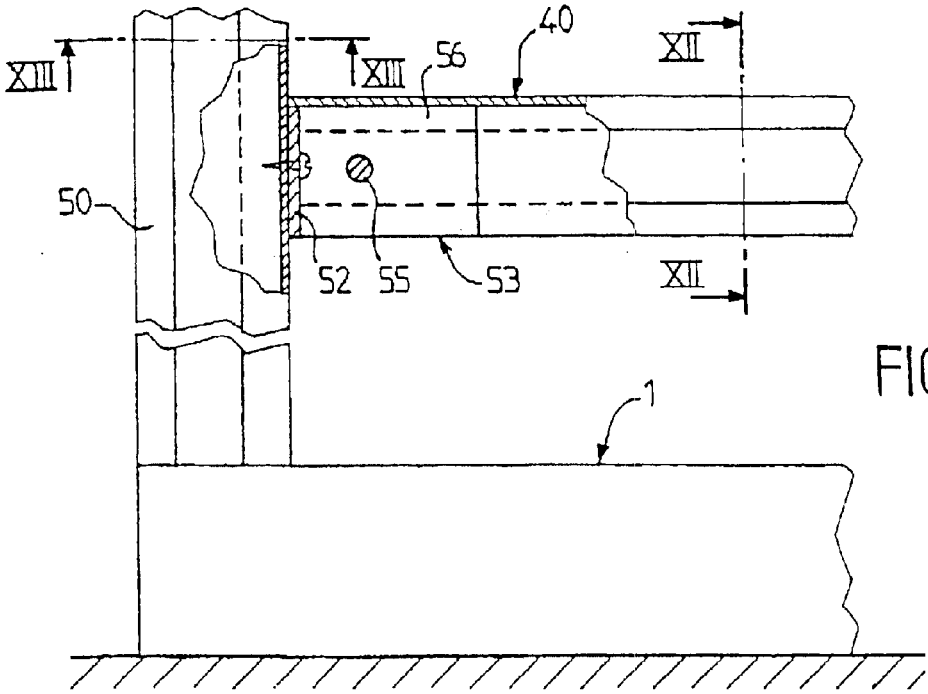
FIG. 11 is a side view with partial vertical section of the association of a profiled section according to the invention used as plinth with a complementary profiled section and another profiled section, the assembly being intended to constitute a partition part.
Figure 12:
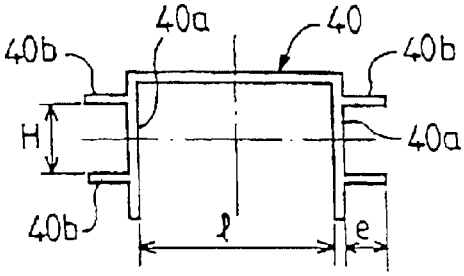
FIG. 12 is a vertical cross-sectional view of a first complementary profiled section along line XII—XII of FIG. 11.
Figure 13:
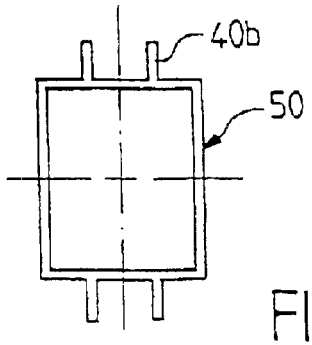
FIG. 13 is a horizontal cross-sectional view of a second complementary profiled section along line XIII—XIII of FIG. 11.

FIG. 11 shows an association of a basic profiled section 1 according to the invention with a first complementary profiled section 40 used as horizontal upright and a second complementary profiled section 50 which, as shown in FIG. 13, is a complementary profiled section 40 of which the ends of the U-shaped branches have been joined by an element parallel to its base so as to form a rectangular cross-section.

Such an association of profiled sections is particularly interesting insofar as it makes it possible to arrange between the complementary profiled section 40 and the basic profiled section 1 any means appropriate for producing a specific partition.

In such a form of embodiment of the invention, the complementary profiled section 50 is fixed on the basic profiled section 1 by means of a U-shaped element of the type used in FIG. 10. In this form of embodiment, the fixation of the profiled section 40 on the profiled section 50 is likewise effected by a U-shaped element 53 of which the base 52 is fixed by screwing in the wall of the profiled section 50. The complementary profiled section 40 is fixed on the U-shaped element 53 by screws 55 which are screwed in the flanges 56 thereof In order to facilitate positioning of the structure as best possible for the user, each of the profiled section elements, whether it be question of a principal profiled section or of a complementary profiled section, may be cut out to the desired size in the factory.

In a form of embodiment of the invention, angular elements may be produced in the factory, composed of an association of two principal profiled sections as shown in FIGS. 6 and 7 or of a principal profiled section and a secondary profiled section as shown in FIGS. 8 to 10. These angular elements will have a short length and will be intended to be combined with rectilinear elements, their practical interest being to avoid the installer having to make right-angled connections of profiled sections on the site.

What is claimed is:

1. An elongated structural section for holding a partition, comprising:

two parallel elongated U-shaped parts and a transverse part joining inner walls of said two U-shaped parts, said two U-shaped parts having closed, flat bottoms in a plane that defines a base of the structural section and open ends that are arranged to receive parallel partition sections, said transverse part being attached to each of said inner walls along a line that is generally parallel to and spaced from said base and spaced from a distal end of said inner wall.

2. The structural section of claim 1, wherein outer walls and the inner walls of said two U-shaped parts are in planes that are all parallel to each other over their entire length and perpendicular to said base.

3. The structural section of claim 1, wherein outer walls of said two U-shaped parts are longer than the inner walls by a distance that is substantially equal to a thickness of said transverse part.

4. The structural section of claim 1, wherein a distance between outer walls of said two U-shaped parts is twice a length of the outer walls.

5. The structural section of claim 1, further comprising a complementary section that includes a U-shaped element with a flat base whose width is equal to a distance between the inner walls of said two U-shaped parts, and two parallel flanges extending outwardly from each of opposite sides of said U-shaped element to a distance equal to a distance between inner and outer walls of one of said two U-shaped parts.

6. The structural section of claim 5, further comprising a bent piece that attaches said transverse part to each of two interior sides of said U-shaped element.

7. The structural section of claim 1, further comprising a second transverse part that is releasably attachable to the inner walls of said two U-shaped parts at distal ends thereof.

8. A partition structure, comprising:

a pair of parallel partition sections; and two parallel elongated U-shaped parts and a transverse part joining inner walls of said two U-shaped parts, said two U-shaped parts having closed, flat bottoms in a plane that defines a base of the structural section and open ends that receive said partition sections, said transverse part being attached to each of said inner walls along a line that is generally parallel to and spaced from said base and spaced from a distal end of said inner wall.

9. The partition structure of claim 8, further comprising a second pair of parallel partition sections that are received in a further pair of said parallel elongated U-shaped parts joined by another said transverse part, wherein the flat bottoms of said further pair of U-shaped parts are attached to the flat bottoms of said two U-shaped parts.

10. The partition structure of claim 9, further comprising third pair of said parallel elongated U-shaped parts joined by yet another said transverse part, wherein the flat bottoms of said third pair of U-shaped parts are attached to corresponding outer walls of said further pair of U-shaped parts and said two U-shaped parts.

11. The partition structure of claim 8, wherein outer walls and the inner walls of said two U-shaped parts are in planes that are all parallel to each other over their entire length and perpendicular to said base.

12. The partition structure of claim 8, wherein outer walls of said two U-shaped parts are longer than the inner walls by a distance that is substantially equal to a thickness of said transverse part.

13. The partition structure of claim 8, wherein a distance between outer walls of said two U-shaped parts is twice a length of the outer walls.

* * * * *